United States Patent [19]

Kochsmeier

[11] Patent Number: 4,993,320

[45] Date of Patent: Feb. 19, 1991

[54] INKING ROLLER AND METHOD FOR THE PRODUCTION THEREOF

[75] Inventor: Hans-H. Kochsmeier, Bovenden, Fed. Rep. of Germany

[73] Assignee: W. Haldenwanger Techn., Berlin, Fed. Rep. of Germany

[21] Appl. No.: 375,838

[22] Filed: Jul. 5, 1989

[30] Foreign Application Priority Data

Jul. 5, 1988 [DE] Fed. Rep. of Germany ..... 3822692
Feb. 4, 1989 [DE] Fed. Rep. of Germany ..... 3903372

[51] Int. Cl.[5] ..... B41F 31/26

[52] U.S. Cl. ..... 101/148; 29/121.1; 29/132; 29/895.32

[58] Field of Search ..... 101/348, 349, 350; 29/148.4 D, 121.1, 132, 895.32, 895.3, 895

[56] References Cited

U.S. PATENT DOCUMENTS 4,009,658 3/1977 Heurich ..... 29/132 X
4,793,041 12/1988 Jenkins et al. ..... 29/132 X

FOREIGN PATENT DOCUMENTS 3713027. 11/1988 Fed. Rep. of Germany ..... 101/348

*Primary Examiner*—Clifford D. Crowder
*Attorney, Agent, or Firm*—William D. Blackman; Arnold S. Weintraub

[57] ABSTRACT

In a method for producing an inking roller in the form of a screen roller for an offset inking mechanism or similar ink applicator, during a scraping process a doctor blade slides over the surface of webs which define a screen system. A metal and/or hard ceramic layer, is applied to the roller cylinder, and a laser beam is used to burn a pattern into the abrasion-resistant, hydrophilic surface of the metal and/or ceramic layer. Hydrophobic lining material at least partly covers the walls of the depressions. A plurality of cells for receiving ink or the like are formed in the lining material of the fillable depressions and the arrangement and structure of the cells are independent of the arrangement and structure of the depressions.

15 Claims, 2 Drawing Sheets

INKING ROLLER AND METHOD FOR THE PRODUCTION THEREOF

BACKGROUND OF THE INVENTION

1. Field of the Invention

Figure 1A:
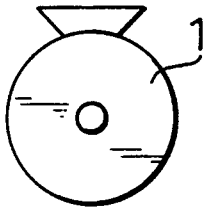

The present invention relates to an inking roller in the form of a screen roller for an offset inking mechanism or similar ink applying means.

2. Prior Art

An inking mechanism of the present type can only fulfill the high demands with regards to the reproducibility of the printing form, and the imaging accuracy on the print carrier, by maintaining constant and correct tonal quality, if it is possible to ensure over a sufficiently long period equally thick ink coatings for the roller transferring the ink. Inking rollers cooperating with a doctor blade which have been provided by the prior art do not generally simulataneously fulfill all the requirements. It has been known in the prior art to scrape excess ink off of the surface of a roller using a doctor blade, leaving ink in depressions formed in the surface of the roller.

As the edge of the doctor blade sufficiently hardened for this purpose slides over the screen roller surface, it must be ensured that the necessarily occurring abrasion remains negligible, particularly if the surface provided for trapping ink with a matrix of cells only has very narrow webs between the cells and consequently there is a small web-cell ratio.

It is known in this connection to apply a preferably hard ceramic coating to the dynamically balanced core of such a roller or to the spherical surface thereof and to engrave the necessary number and shape of the cells or depressions into such a surface by means of a laser beam. These known rollers known as Laserlox with standard doctor blade use give more than 200 million running metres without any detectable wear and therefore without any significant change to the volume absorption for the cells. However, it is considered inadequate that the hydrophilic ceramic material can lead to problems in transferring the damping agent, so that the actual ink impression has a watered down appearance.

Inking mechanisms operating with highly viscous printing inks, such as is, e.g., the case with offset printing presses, make use of a dip roller dipped into an ink pan, an inking roller inking a printing form applied to a cylinder and a transfer roller transferring the ink from the dip roller to the inking roller, the transfer roller with the ink trapping depressions and the interposed webs bearing an image in a halftone or screen arrangement. In order to be able to guarantee a uniformly thin ink film, so-called ink storage or conditioning rollers are associated with the transfer roller. For bringing about a dosed ink transfer, it is conventional practice to provide control means, which can be manually adjusted for each individual case, which not only require increased construction costs, but also complicated operation.

Screen rollers for an offset inking mechanism with cells defined by webs which can be scraped are known, and have an outer surface made from a ceramic material, in which the cells have a hydrophobic lining (DE-OS 37 13 027). The prior art screen roller, which in the known arrangement is made from steel, cooperates with an inking roller to which, besides the ink, is supplied a damping agent. This again creates a risk that the damping agent required for wetting the printing plate passes via the inking roller to the screen roller and has a negative influence on the adhesion of the ink in the cells, and therefore on the filling of the latter with ink, so that there can be fluctuations in the ink quantity and density. For this reason, particular attention is paid to the hydrophobic lining of the cells. In connection with a multilayer roller construction, attention is paid to an optimum material selection for each individual layer and aluminum oxide or chromium oxide has been found to be a particularly advantageous wear-resistant material for the hard ceramic coating, which can be engraved by means of a laser beam. Following engraving, the hydrophobic material layer is applied in the form of a uniformly thin copper layer with a thickness of 20 to 50 $\mu$ in such a way that, on the one hand, high wear resistance through the webs made from hard ceramic material is ensured, and, on the other, the high affinity of this ceramic material for water, which is disadvantageous for printing, can be avoided in the vicinity of the cells by a thin evaporation coated copper layer. An initially very thinly evaporation coated copper film 4 to 5 $\mu$ thick can be subsequently brought to the aforementioned thickness galvanically, the copper film then passing over the complete screen surface of the inking roller. The initially uniform copper film can, if desired, subsequently be ground from the vicinity of the hard ceramic web surface prior to the use of the roller.

In this known inking roller, the shape and size of the halftone screening of the ceramic layer necessarily determines the volume of the ink metering cells, the web width of the engraving in the ceramic surface serving as a further ink volume control.

It is worth mentioning in this connection that such multilayer rollers are also known in such a form that the radially external oxide layer to the roller axis has the same thickness approximately everywhere in the vicinity of the cells. Preferably aluminum is used as the carrier material and alumina as the hydrophobic coating. The depressions in the screen roller surface along the base face and in the vicinity of the webs between the cells have higher oxide coatings than along the sloping cell walls, here again the lining layer being produced in the galvanic oxidizing bath (DE-OS 36 15 141).

SUMMARY OF THE INVENTION

The present invention is based on the aforementioned prior art and its problem, in the case of a multilayer roller of the aforementioned type, is to bring about optimum screening for doctor blade operation of the abrasion-resistant metal and/or ceramic layer applied to the spherical surface of the roller cylinder. The screening of the cells metering the ink applied should also be independent of the abrasion - resistant layer and therefore once again of an optimum nature for the printing substrate.

Figure 1B:
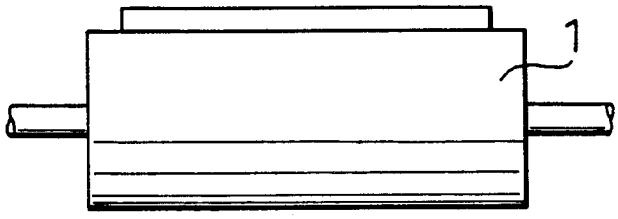

The inking roller produced according to the present method is suitable in a particularly advantageous manner for the application of offset inks, but is also suitable for other print application media. It has surprisingly been found that for multi-layer screen rollers of the present type, by combining a laser-engraved ceramic layer and an etched metal layer, not only is a very economical solution obtained, but also an inking roller is provided which satisfies maximum quality requirements during an extremely long period of operation. The wear-resistant layer can be preselected in accordance with a predetermined number of screens and with optimized matching between the number of webs and the web surface or width, as well as doctor blades, independently of the screening of the ink cells, their shape and arrangement optimized for ink application. In individual cases it can be advantageous to produce the upper hydrophobic metal layer not by chemical etching engraving, but mechanically by stroke engraving or the like, or physically by laser beam and electron beam engraving. Only the complete filling of the depressions in the ceramic layer with hydrophobic lining material, advantageously over and beyond the height of the ceramic webs, makes it possible to bring about an independence of the second engraving for producing the ink trapping cells. For the latter copper is a known, very advantageous material. In much the same way as the ceramic layer, it can e.g. be applied by a plasma spraying. The invention is described in greater detail hereinafter relative to non-limitative embodiments and the attached drawings, which show:

FIG. 1 a diagrammatically simplified plan and side view of an inking roller.

Figure 2:
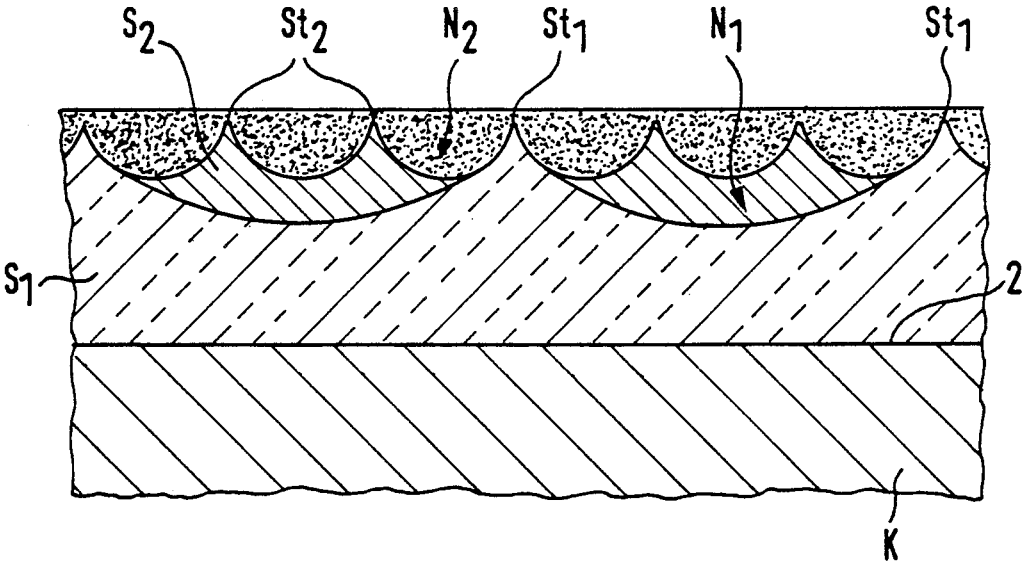

FIG. 2 the multilayer arrangement of the surface coatings of the roller according to FIG. 1.

Figure 3:
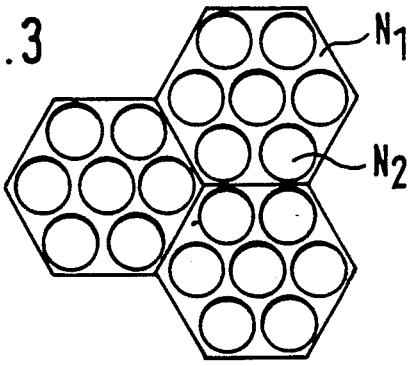

FIG. 3 a possible engraving pattern for the depressions in the ceramic layer and the cells in the lining layer.

Figure 4:
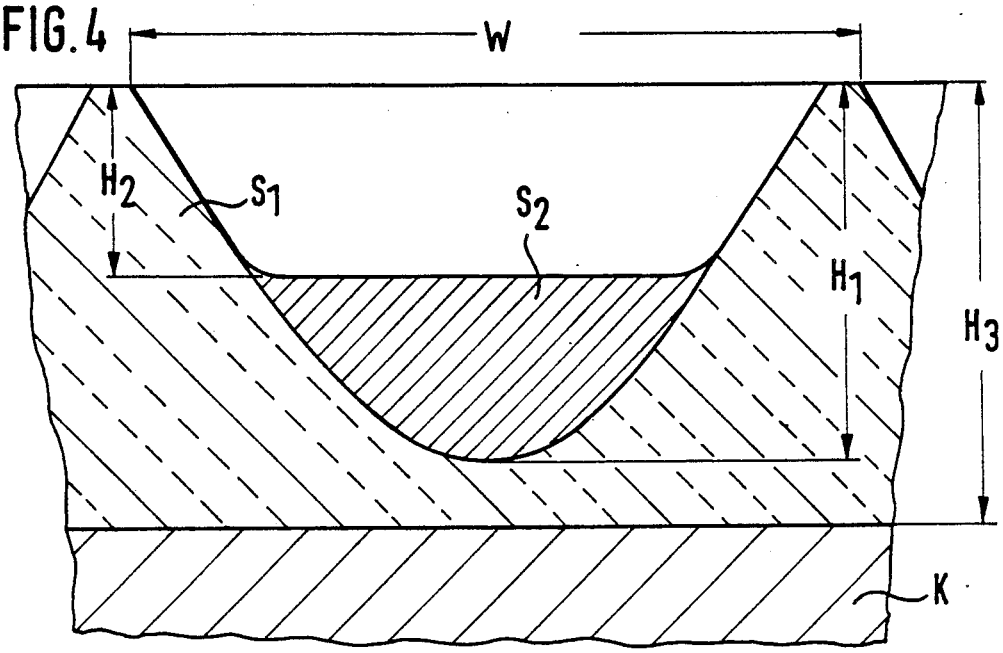

FIG. 4 a cross-section through a cell for another advantageous embodiment.

Figure 5:
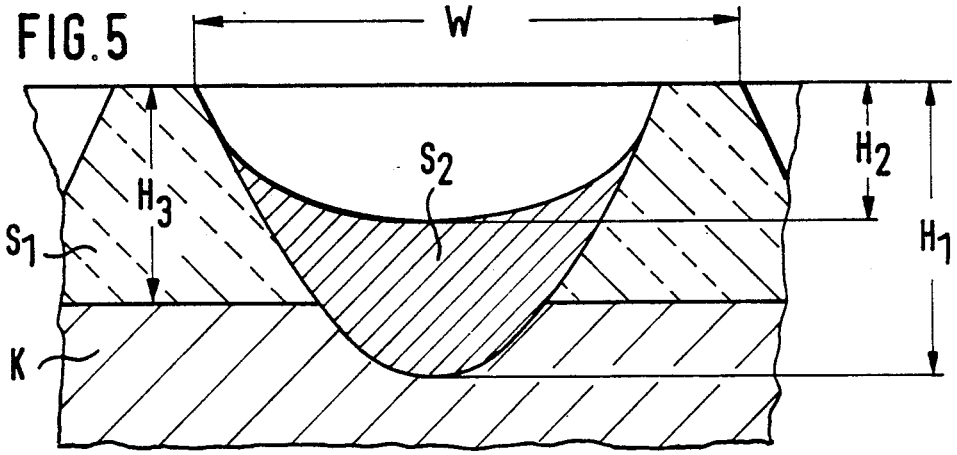

FIG. 5 like FIG. 4, but with $H_1$ larger than the ceramic layer thickness.

The inking roller of FIG. 1 in side view over a and in longitudinal view over b has the layer arrangement shown in detail and cross-section in FIG. 2. Thus, to the steel core K of the roller cylinder a hard sintered or ground metal and/or ceramic layer $S_1$ is applied to spherical surface 2 by means of a plasma torch, and cup-shaped depressions N, are cut into the outer circumferential surface thereof by laser engraving. Depressions $N_1$ can be seen between the first webs $St_1$ which define the screen-like surface pattern of the ceramic layer $S_1$. The webs $St_1$ also provide a stripping surface for a doctor blade, if ink is applied to the inking roller. The represented screen roller can be advantageously used e.g. for direct or indirect inking of a cylindrical plate. Among the various offset printing processes, reference is made in this connection e.g. to the Anilox process using screen rollers having surfaces which are hydrophobic, but have a particular affinity for oil inks. In the known Anilox offset printing process it is necessary to use doctor blades, which lead to wear phenomena and therefore frequent stoppages during production. Known materials with wear-resistant, but hydrophobic characteristics have the per se known ink application irregularities, so that it is not possible to remove the aforementioned disadvantages with a screen roller of exclusively wear-resistant ceramic layer and laser engraving. This only permits an optimization of the screen pattern and the stripping surface along the ceramic webs for the doctor blades, but does not provide corresponding conditions for the cavities transferring the ink or the like. Thus, in a further operation according to the present invention the engraved layer $S_1$ is covered with a lining $S_2$, whose thickness preferably projects over the height of the ceramic webs $St_1$ and whose material choice is such that it has the desired oleophilic, hydrophobic characteristics. In the present embodiment layer $S_2$ is of copper. As by means of per se known procudures, copper can be applied to the ceramic layer and therefore into depressions $N_1$, with a sufficiently firm anchoring, and subsequently the second layer $S_2$, i.e., the lining material, is removed to such an extent that the first webs $St_1$ are exposed. This gives a smooth cylindrical surface consisting of the screen-like copper fillings within the depressions $N_1$ and the ceramic webs $St_1$ interrupting the same in row or line-like manner. In order that the inking roller can absorb the offset printing ink, into the surface thereof a second engraving is now made independently of the first and in the form of a plurality of cells $N_2$. In the present embodiment the number of screens of the screen system defined by cells $N_2$ is larger by an intergral multiple than the screen system of the engraving within the wear-resistant layer $S_1$. Thus, the screen system of the first layer $S_1$ with its first webs $St_1$ exclusively defines the contact surface with respect to the doctor blade, whereas that of the cells $N_2$ and therefore the second engraving is used exclusively for ink metering or dosing.

The two engravings on the screen roller 1 can be produced completely independently of one another and the screen system of the first webs $St_1$, and of the second webs $St_2$ can be an integral or broken multiple of one another and vice versa and can also periodically or aperiodically repeat. In the case of one engraving, e.g. the webs can be partly interrupted by the second engraving, which is unimportant for the wear-resistance of the surface of screen roller 1 engaging with the doctor blade, because the bearing part of the webs $St_1$ is only insignificantly reduced by such interruption. The bearing part is generally understood to mean the ratio of the web surface to the spherical surface. The bearing part can be adjusted within wide limits by the engraving type. A typical range of values is between 25% to below 2%. Both the depressions $N_1$ and the cells $N_2$ can have a random cross-section, which applies with respect to the design of the active surface thereof.

The second webs $St_2$ between the lining material or the second layer $S_2$ and which separate the cells $N_2$ from one another is advantageously at the same level, i.e. aligned with the webs $St_1$ of the wear-resistant layer $S_1$. However, they can also be slightly radially inwardly directed with respect thereto, so that it is possible to prevent engagement of the doctor blades with the second webs $St_2$.

Layer $S_2$ is an ink-receptive, water-repelling layer, whereas layer $S_1$ is a wear-resistant, hydrophilic layer. The number of screens for the engravings made in the individual layers can be in a fixed relationship to one another. Based on the print substrate web travel direction, the engraving angle should be such that there can be no moire pattern on the printing material.

FIG. 3 shows in detail an engraving pattern, the depressions $N_1$ being in honeycomb form in plan view, while the cells $N_2$ have a circular outline. The number of screens for the cells $N_2$ is greater than that for the depressions $N_1$ in this case.

FIG. 4 shows another embodiment for the cells and is shown in cross-section. For producing this cell, initially the wear-resistant layer $S_1$ is engraved in accordance with a desired, predeterminable number of screens. The engraved layer is then filled with the second layer $S_2$, e.g. with copper, which is then removed, by acid etching or other appropriate method, to such an extent that the first webs $St_1$ are exposed. As a result of a following etching engraving the copper is removed from the cells to such an extent that the exposed volume thereof precisely corresponds to the desired value for the metering of the ink.

The thickness of the wear-resistant layer $S_1$, which is indicated by reference $H_3$ in FIG. 4, is in this embodiment larger than the $H_1$ of the cell to be subsequently introduced into the surface of the screen roller. The depth of the represented cell is $H_1$, which is e.g. 50 $\mu$, whereas the depth left open to receive ink, $H_2$, can be 25 $\mu$ deep. Layer $S_2$ is engraved with etching fluid, which dissolves the layer but does not attack the wear-resistant layer $S_1$. The etching process is continued until layer $S_2$ has dissolved to such an extent in the vicinity of the cell that the desired cell volume has the predetermined actual value. In other words, the depth range of the cell has a metallic surface, which has the oleophilic and hydrophobic property required by the cell wall. However, the wear-resistant webs are fully maintained in the desired screen system for the doctor blades, so that this provides an additional advantage to those described in connection with the embodiment according to FIGS. 1 to 3.

In the embodiment according to FIG. 5, each cell is formed in that as a result of laser engraving, not only is there a perforation of the wear-resistant, hydrophilic material, but also of the metal base and the exemplified cup shape is formed. The lining material of the second layer to be introduced, i.e., the copper material here, gives the metallic base of the cell a particularly good adhesion and leads to an integral union between the two metals. In FIG. 5, in a manner analogous to FIG. 4, $H_1$ shows the depth of the cell. $H_1$ in this case is greater than $H_3$, the depth of the ceramic or wear-resistant layer $S_1$. $H_2$ is the depth left open to receive ink, while the depth of the copper layer $S_2$ is the difference between $H_1$ and $H_2$, as may be seen from an inspection of FIG. 5.

It is also possible with the inking roller according to the present invention to dose a damping agent into a printing or damping mechanism. The layer and engraving parameters are so modified with respect to an inking roller, that an adequately uniform damping agent film can form on the printing plate or substrate.

Having, thus, described the invention, what is claimed is:

1. A method for the production of an inking roller for an inking mechanism comprising the steps of:

(a) applying an outer abrasion-resistant layer to a dynamically balanced roller cylinder;

(b) engraving a pattern in the abrasion-resistant layer by laser beam to define a first surface screen system, the pattern leaving upstanding webs between exposed depressions;

(c) filling the engraved depressions substantially completely with hydrophobic lining material;

(d) partially removing the lining material until the webs are exposed; and (e) forming a plurality of cells in the lining material, the cells being independent of the depressions as regards arrangement and structure thereof, for receiving ink therein for a printing process.

2. The method of claim 1, wherein the cell forming step is carried out by means of an etching process so as to provide a second surface screen system.

3. The method of claim 1, characterized in that the abrasion-resistant, ayer is applied to the roller cylinder by a plasma spraying process.

4. The method of claim 1, a cell forming step comprises an engraving process.

5. An apparatus for transferring ink, comprising a dynamically balanced roller cylinder, a ceramic layer applied to its surface and having a plurality of depressions formed in the surface thereof and defining between them first webs; a layer of hydrophobic lining material at least partially filling the depressions, the layer of hydrophobic material having a plurality of cells formed therein, the cells defining second webs therebetween.

6. An apparatus according to claim 5, characterized in that the hydrophobic lining material of the depressions comprises copper.

7. The apparatus of claim 5, characterized in that the number of the cells per unit distance on the roller surface is an integral multiple of the number of depressions in said unit distance.

8. The apparatus of claim 5, characterized in that the depressions are defined by engraving and that the cells are defined by engraving which are finer than the engravings of the depressions.

9. An apparatus according to claim 5 wherein the arrangement and structure of the cells is independent of the arrangement and structure of the depressions.

10. Apparatus according to one of the claims 5 to 9, characterized in that the surface of the apparatus is constructed and arranged in such a way that no moire pattern is formed thereby on a print substrate.

11. The apparatus of claim 5, characterized in that the roller cylinder is formed of metal.

12. An apparatus according to one of the claims 5 to 8, characterized in that the depressions pass completely through the ceramic layer and the hydrophobic liner contacts the roller cylinder.

13. The apparatus of claim 5, characterized in that the first and second webs have substantially the same height at the outermost surface thereof.

14. The apparatus of claim 5, characterized in that the maximum height of the first webs is greater than the maximum height of the second webs.

15. The apparatus of claim 5, characterized in that the maximum height of the first webs virtually equals the maximum height of the second webs.

* * * * *